US006474486B1

(12) United States Patent
Baraniak

(10) Patent No.: US 6,474,486 B1
(45) Date of Patent: Nov. 5, 2002

(54) METHOD OF TELESCOPING A CRANE JIB, APPARATUS FOR IMPLEMENTING THE METHOD, AND A CRANE JIB CONSTITUTING AN APPLICATION THEREOF

(75) Inventor: Robert Baraniak, Saint-Vallier (FR)

(73) Assignee: P P M, Montceau les Mines Cedex (FR)

( * ) Notice: Subject to any disclaimer, the term of this patent is extended or adjusted under 35 U.S.C. 154(b) by 47 days.

(21) Appl. No.: 09/709,736

(22) Filed: Nov. 13, 2000

(51) Int. Cl.[7] ..... B66C 23/687
(52) U.S. Cl. ..... 212/292; 212/349
(58) Field of Search ..... 212/292, 348, 212/349, 350

(56) References Cited

U.S. PATENT DOCUMENTS 5,628,416 A 5/1997 Frommelt et al.
6,216,895 B1 * 4/2001 Erdmann ..... 212/292

FOREIGN PATENT DOCUMENTS

| | | | |
|---|---|---|---|
| EP | 476225 | * 4/1991 | |
| EP | 488990 | * 6/1992 | ..... 212/348 |
| FR | 2708584 | 2/1995 | |
| WO | 98/54081 | * 12/1998 | |

* cited by examiner

*Primary Examiner*—Steven A. Bratlie
(74) *Attorney, Agent, or Firm*—Dennison, Schultz & Dougherty

(57) ABSTRACT

The invention relates an apparatus for hoisting and handling equipment wherein the apparatus includes locking members having a locking block (30) carried by each telescopic element and including clamping member which is clamped in a rest position, an immobilization piece (40) carried by each element outside the element carrying a block configured to cooperate with the clamping member.

42 Claims, 9 Drawing Sheets

FIG.12
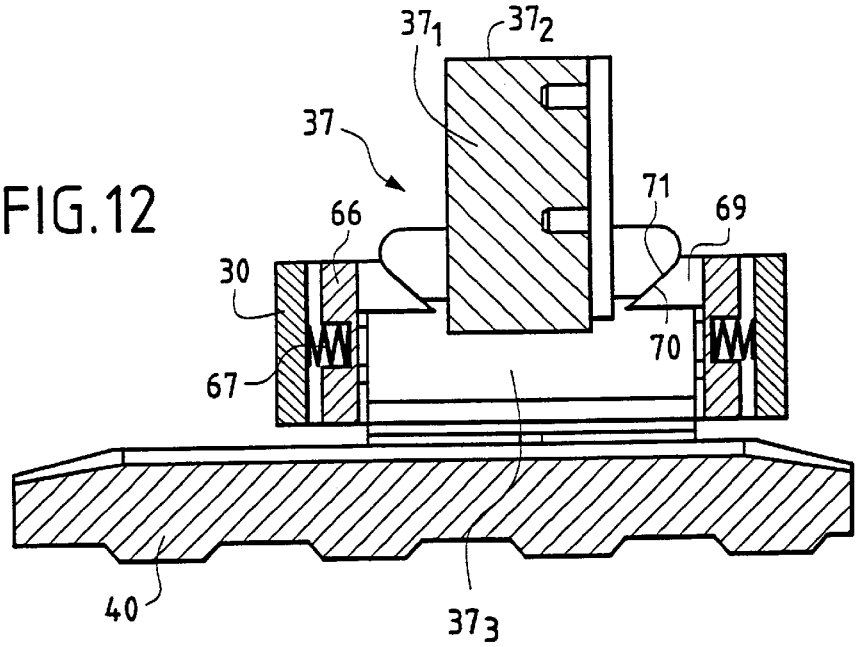
FIG.13
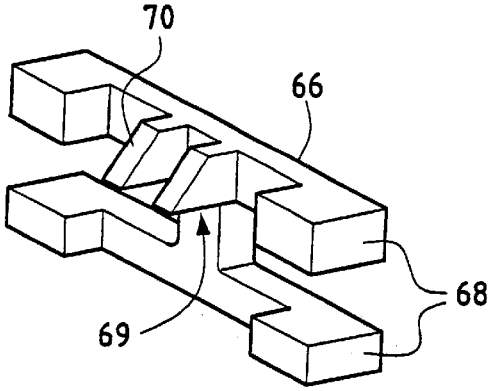
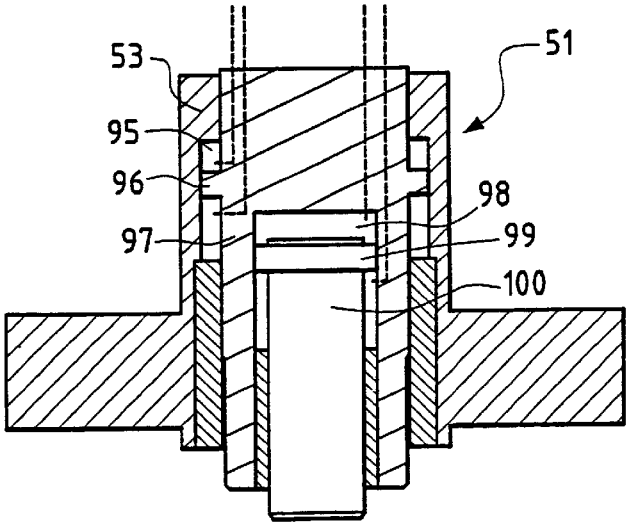
FIG.16

METHOD OF TELESCOPING A CRANE JIB, APPARATUS FOR IMPLEMENTING THE METHOD, AND A CRANE JIB CONSTITUTING AN APPLICATION THEREOF

The present invention relates to the technical field of telescopic booms or jibs for cranes, whether installed on fixed installations or carried by mobile structures, whether self-propelled or not.

BACKGROUND OF THE INVENTION

In the above technical field, telescopic jibs are generally mounted on a turntable that is steerable in azimuth relative to a carrier structure, and the turntable carries a jib that is tiltable in elevation, the jib being made up of at least three distinct telescopic elements.

The first element is referred to as a "base" element and is generally connected to the elevation tilt axis, the second element is referred to as an "intermediate" element, and the third element is referred to as an "end" element and usually carries at least one jib head sheave. These three elements are intended to enable the length of the jib to be adjusted, so as to vary the distance or length between the elevation adjustment axis and the jib head sheave over which a cable passes and is guided, which cable is wound in or out from a base winch in order to vary the height of a load suspended from the portion of the cable that extends beyond the jib head sheave.

Initially, implementing a jib of the above type required the existence of technical means suitable for making it possible to adjust telescoping while under load so as to make it possible to adjust jib length relative to the vertical through a determined point relative to which a load was to be lifted, lowered, put into position, or removed.

To be able to perform such a function, it was necessary to provide relative sliding means between the telescopic elements capable of accommodating the stresses that arise while telescoping under load, and it was necessary to implement telescoping means that were particularly powerful in order to overcome the friction induced by sliding under load.

Such means are particularly expensive, they must be designed to be very robust, and they need to be subjected to very thorough maintenance so that the essential or prime function of the crane can be carried out in complete safety. Furthermore, such means represent considerable weight to the detriment of the functional capacity of the jib.

For some time, attempts have been made to emphasize prior telescoping while unloaded, while nevertheless still having the possibility of enabling the stroke of one element to be telescoped under load. Such a method makes it possible to install telescoping power that enables the unloaded jib to be set to length while nevertheless retaining the possibility of modifying said length over the stroke of a single element at reduced load. That method has the advantage of not straining the locking and unlocking members.

That technique consists in determining a priori the length that needs to be conferred to the jib so that from the site on which it stands it can reach a position vertically above the point where a load is to be picked up or put down, or indeed a locus which this point is capable of following, e.g. a portion of a circle, and then in adjusting the length of the jib accordingly.

To enable those techniques to be implemented, an actuator is placed inside a telescopic jib, which actuator is suitable for performing rectilinear displacement in both directions, and is connected, for example, to the base element and movable relative to the end element.

In general, such an actuator is constituted by a double-acting hydraulic actuator of single predetermined stroke which corresponds generally to the longest retraction or extension stroke that can be performed by any of the moving elements, naturally excluding the base element which is considered as being fixed.

The above technical means need to satisfy two basic requirements.

The first is to be able to hold the telescopic elements in a mutually locked configuration both in the retracted position and in the extended position.

The second is the need to be able to engage selectively by any one of the telescopic elements to release it from the position it is occupying and then drive it to a desired new position in which it must again be locked.

To make that possible, the prior art has various proposals.

Mention can be made of application EP 0 476 225 which mentions implementing a telescoping head carried by the actuator and suitable for causing locking blocks to be retracted or extended relative to complementary housings presented by the internal ends of the telescopic elements which are also interconnected in the retracted position by other selectively controllable members which need to be actuated synchronously.

That document would not appear to specify how the elements are caused to be locked together in the extended position.

In any event, it should be observed that that technology uses a series of locking members and engagement members which are superposed and which need to be fed with energy in the form of a fluid under pressure, which energy must be delivered in accurately synchronized manner in order to obtain the desired result which, by way of example, when performing outward telescoping, necessarily requires the following to be performed in sequence: the element concerned is engaged; the element is unlocked; the element is caused to slide relative to the others into its new position; in which position it must again be locked.

Mention can also be made of German application DE 4 344 795 in which, between the actuator and each of the telescopic elements, there are provided engagement means of the same kind as in the above-described application, and locking means which are constituted by engaging pins that need to be controlled separately during retraction in order to release one element relative to another.

Although that technology appears to be technically simpler than the technology of the preceding application, it nevertheless requires two types of control member to be implemented that are capable selectively of connecting the actuator to any one of the elements to be displaced, and of releasing said element that is to be displaced relative to the next element.

Such a requirement means that specific control circuits need to be established and moving members need to be present that are specific to each of those functions, and as a result, overall the telescoping apparatus is cumbersome to install, to put into operation, and to maintain, and it is not possible for it to claim any genuine savings in weight or mass compared with the solution proposed in application EP 0 476 225.

OBJECTS AND SUMMARY OF THE INVENTION

The object of the invention is to propose a novel telescoping technique and novel means for implementing it so as to be able to perform the above functions in complete safety while using equipment of reduced weight. An object of the invention is to be able to transfer the weight saving obtained in this way to the benefit of jib construction, thereby enabling the effectiveness of the jibs to be reinforced without it being possible overall to consider that the total mass has changed to such an extent as to reduce functional capacity.

The invention proposes a novel technique and novel implementation means making it possible from a combination of two mutually co-operating technical means to perform both functions comprising firstly causing the actuator to operate in temporary manner to engage or to couple with one of the telescopic elements in order to apply thrust thereto, and secondly to release the telescopic element from the element which surrounds it so as to allow relative displacement between the elements, and conversely the opposite functions when it is appropriate to lock in the desired new position any one of the elements that have been moved so that it can then be decoupled from the actuator.

To achieve the above objectives, the method of the invention consists in:

- implementing on each element other than the base element a locking block including a clamping member having a clamped rest position;
- causing the clamping member of each block to co-operate with at least one fixed-position immobilization piece belonging to the element disposed concentrically outside the element carrying the block; and
- causing the actuator to carry a member suitable for acting selectively on each of the locking blocks for the purposes of temporarily coupling or engaging them and for positively unclamping them;
- by positive action firstly to connect said actuator to said block and secondly to neutralize the action of the clamping member on the immobilization piece; and
- by retraction firstly to immobilize said block relative to the clamping piece and secondly to release the actuator relative to said block.

The invention also provides telescoping apparatus capable of implementing the above method, wherein:

- the locking members are constituted by:
  - a locking block carried by each element other than the base element, and including a clamping member having a clamped rest position; and
  - at least one immobilization piece of fixed position belonging to the outer element disposed concentrically about the element carrying a block and designed to co-operate with the clamping member of said block;
- and the driver means on the actuator comprise a single engagement member suitable:
  - for selectively engaging any one of the blocks to couple the actuator temporarily to the element carrying said block; and
  - for taking positive action to neutralize the clamping member of said block so as to release it relative to the immobilization piece.

The invention also provides a jib implementing the above means.

BRIEF DESCRIPTION OF THE DRAWINGS

Various other characteristics appear from the following description made with reference to the accompanying drawings which show embodiments and implementations of the invention as non-limiting examples.

FIG. 12 is an elevation view in section substantially on plane XII—XII of FIG. 4.

FIG. 13 is a fragmentary perspective view of a member in a structural variant.

FIG. 16 is a fragmentary elevation view in section at a different scale showing a variant embodiment of one of the component elements of the apparatus of the invention.

DETAILED DESCRIPTION OF THE PREFERRED EMBODIMENTS

Figure 1:
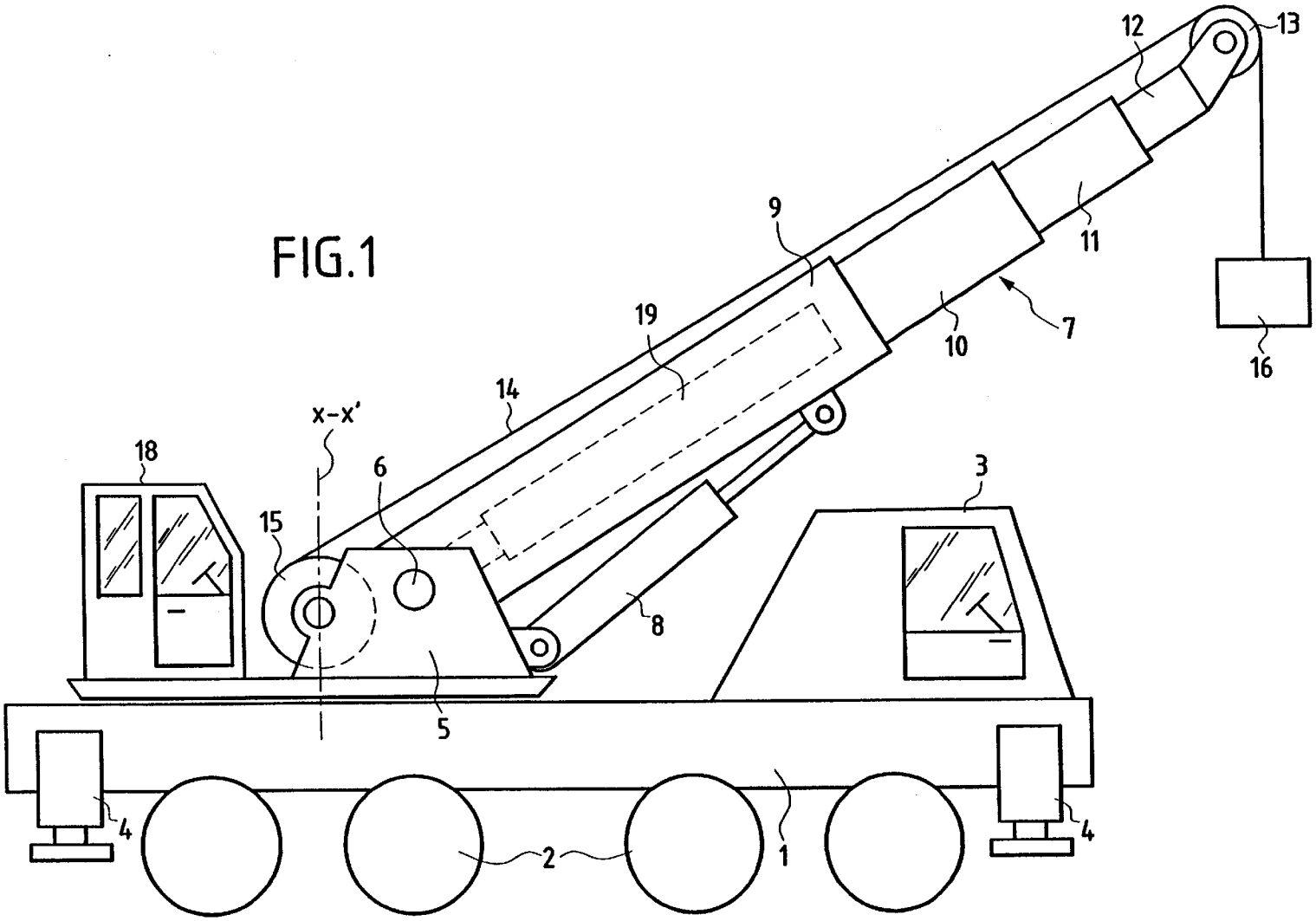
FIG. 1 is a diagrammatic view showing an example of the jib to which the means of the invention apply.

FIG. 1 shows an application of the invention to a crane of the self-propelled mobile type. Such an example is given purely by way of illustration, since the invention can be implemented equally well on a crane that is installed in a fixed location, or to any analogous installation.

The crane of FIG. 1 comprises a platform or frame 1 carried by running members 2, e.g. in conventional manner by a plurality of steering and driving wheel sets. The platform or frame 1 carries a driver's cab 3 which also houses one or more hydraulic and/or driving engine units. The frame 1 carries stabilizing outriggers 4 closed to its front and rear portions so as to ensure a stable base when the crane is in use.

The platform 1 also carries a turntable 5 which is steerable in azimuth about a vertical axis x–x'. The turntable 5 has a horizontal tilt shaft 6 carrying a jib 7 which can be tilted in elevation by means of an actuator 8.

The jib 7 is made up of telescopic elements, e.g. four such elements, comprising a first or base element 9 carried directly on the shaft 6. The elements 10 and 11 are known as intermediate elements, while the element 12 is an end element and carries at least one jib head sheave 13.

The jib 7 also has at least one cable or the like 14 that is wound on and/or off a winch 15 and that passes over the sheave 13 beyond which a cable serves to suspend a load 16.

The turntable 5 is also fitted with a jib cab 18 for controlling the means that actuate the jib such as the actuator 8, the winch 15, and telescoping means 19 included inside the jib 7 and represented by dashed lines in FIG. 1.

Telescoping means such as 19 should be considered broadly as forming part of the prior art, with means of the invention being provided to make it possible with such telescoping means 19 to retract or extend each of the moving telescopic elements individually, i.e. the elements 10, 11, and 12, and to lock each of them in an extended position and also in a retracted position.

The means of the invention make use of apparatus suitable for enabling the telescoping method of the invention to be implemented as described below with reference in particular to FIG. 2.

Such apparatus comprises firstly the actuator 19 which is designed in such a manner as to possess firstly a bearing point 20 associated with the base element 9, and secondly a moving element 21 capable of being driven so as to move along a rectilinear stroke in either direction parallel to the axis y–y' of the jib. The actuator 19 is preferably in alignment on said axis.

In an embodiment, the actuator 19 is constituted by a double-acting hydraulic actuator having a single stage or a single stroke, with a rod 22 secured to the bearing point 20 and a cylinder 23 connected to the moving element 21 and adapted to be carried by the end element 12 with the possibility of guiding its displacement relative thereto. This can be achieved, for example, via a leg 24 provided with wheels or the like 25 and suitable for running along a guide track (not shown).

For the person skilled in the art, implementing an actuator 19 of the type described above can be considered as posing no problems with respect to hydraulic feed even though it is in upside-down position, and that is why the pipes for feeding the two chambers of such an actuator are not shown in the drawings.

Similarly, the drawing does not show any bearing pieces or shoes or spacers interposed to provide support and guidance in relative sliding between the various moving elements such as 12, 11, and 10 and in particular the base element 9.

In the example shown, the moving element 21 is constituted by a telescoping head which is advantageously integrated in the end bearing of the actuator cylinder 23 opposite from its end wall.

The telescoping apparatus of the invention also comprises firstly locking members acting between the telescopic elements to prevent them from moving relative to one another when in the retracted position or the extended position, and secondly means carried by the actuator for the purpose of controlling said locking members.

Figure 2:
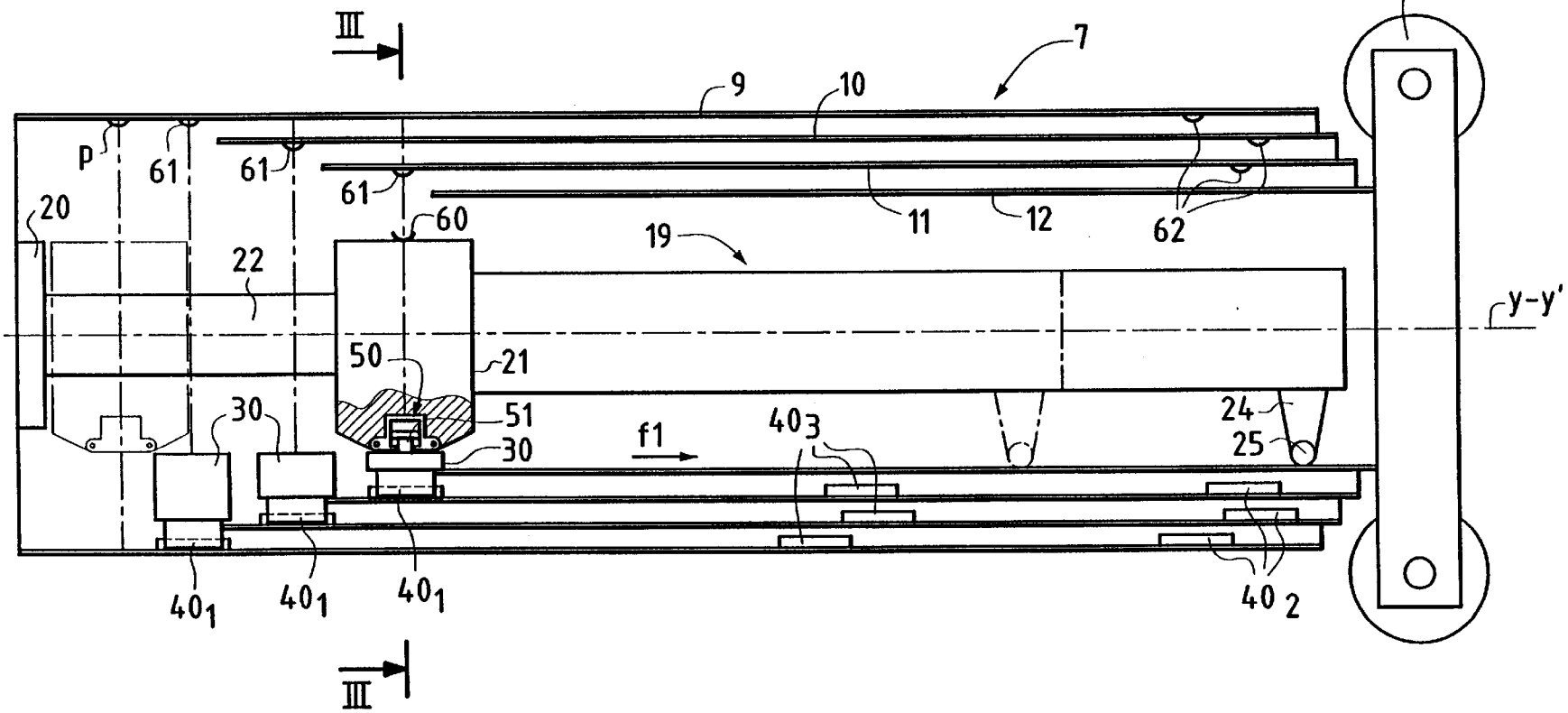
FIG. 2 is a diagrammatic elevation view in section showing a telescopic jib of the invention.
Figure 3:
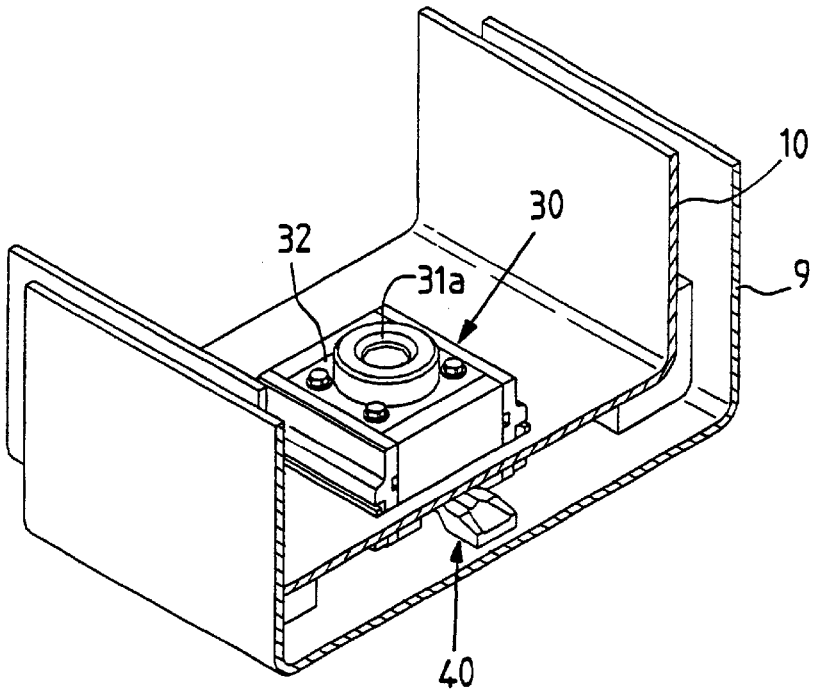
FIG. 3 is a fragmentary perspective view on a larger scale showing a structural detail.
Figure 4:
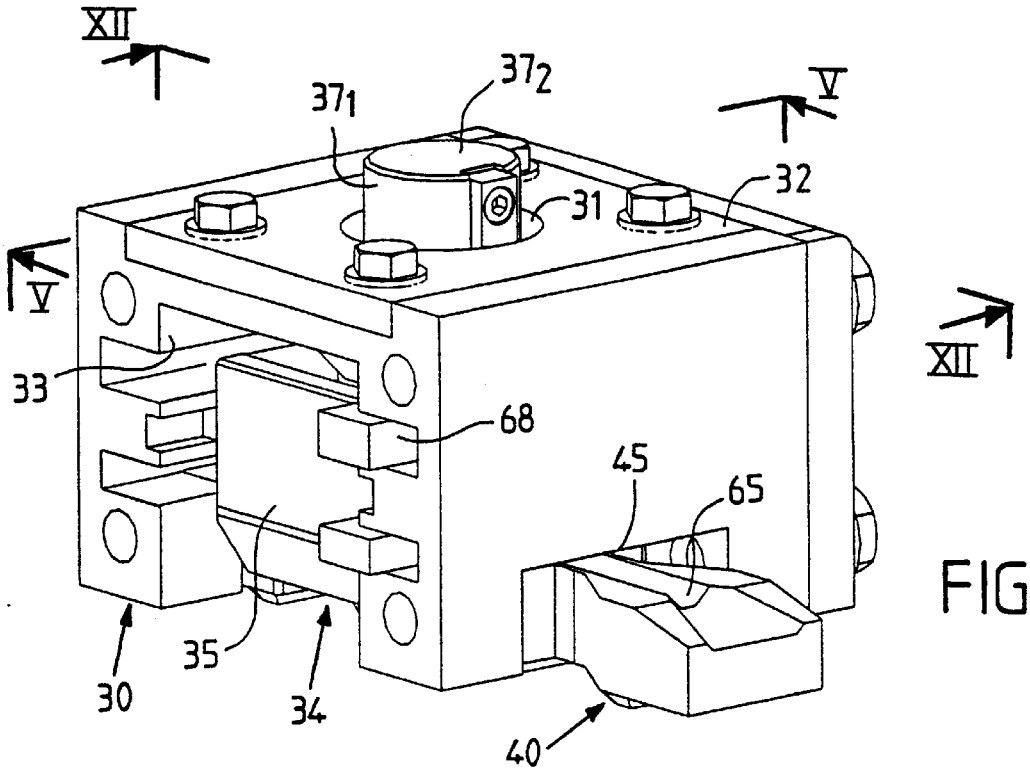
FIG. 4 is a perspective view showing the structure of FIG. 3 in greater detail.
Figure 5:
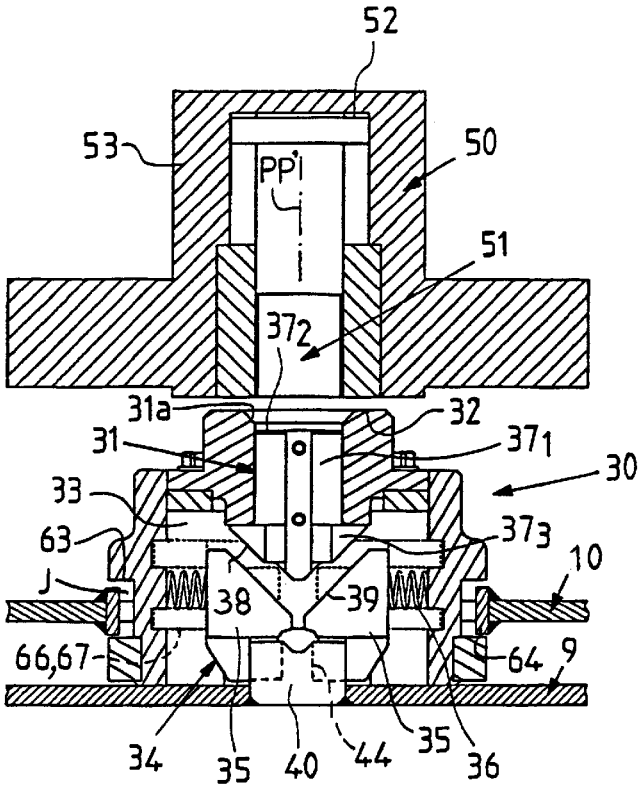
FIG. 5 is a fragmentary section view in elevation and at a different scale on plane V—V of FIG. 4.

In FIGS. 2 to 7, it can be seen that the locking members comprise a locking block 30 carried by the inner end portion of each telescopic element 10, 11, or 12. As can be seen in FIGS. 3 and 4, each locking block 30 defines a well 31 opening out in the top face 32 of the block 30 and also into a cage 33 containing a clamping member 34 having a clamped rest position and constituted by two jaws 35 which are continuously urged towards each other by resilient members 36 (FIG. 5). The jaws 35 are placed facing each other via facing active faces which are situated on either side of a longitudinal midplane P–P' containing the axis y–y'.

Each block 30 also has a plunger 37 designed to co-operate with the jaws 35. For this purpose, the plunger 37 has a shank $37_1$ guided in the well 31, and an actuating face $37_2$ facing towards the face 32. The shank $37_1$ is extended by a head $37_3$ located inside the cage 33 to co-operate via sloping faces 38 with ramps 39 that face each other on the jaws 35.

Figure 8:
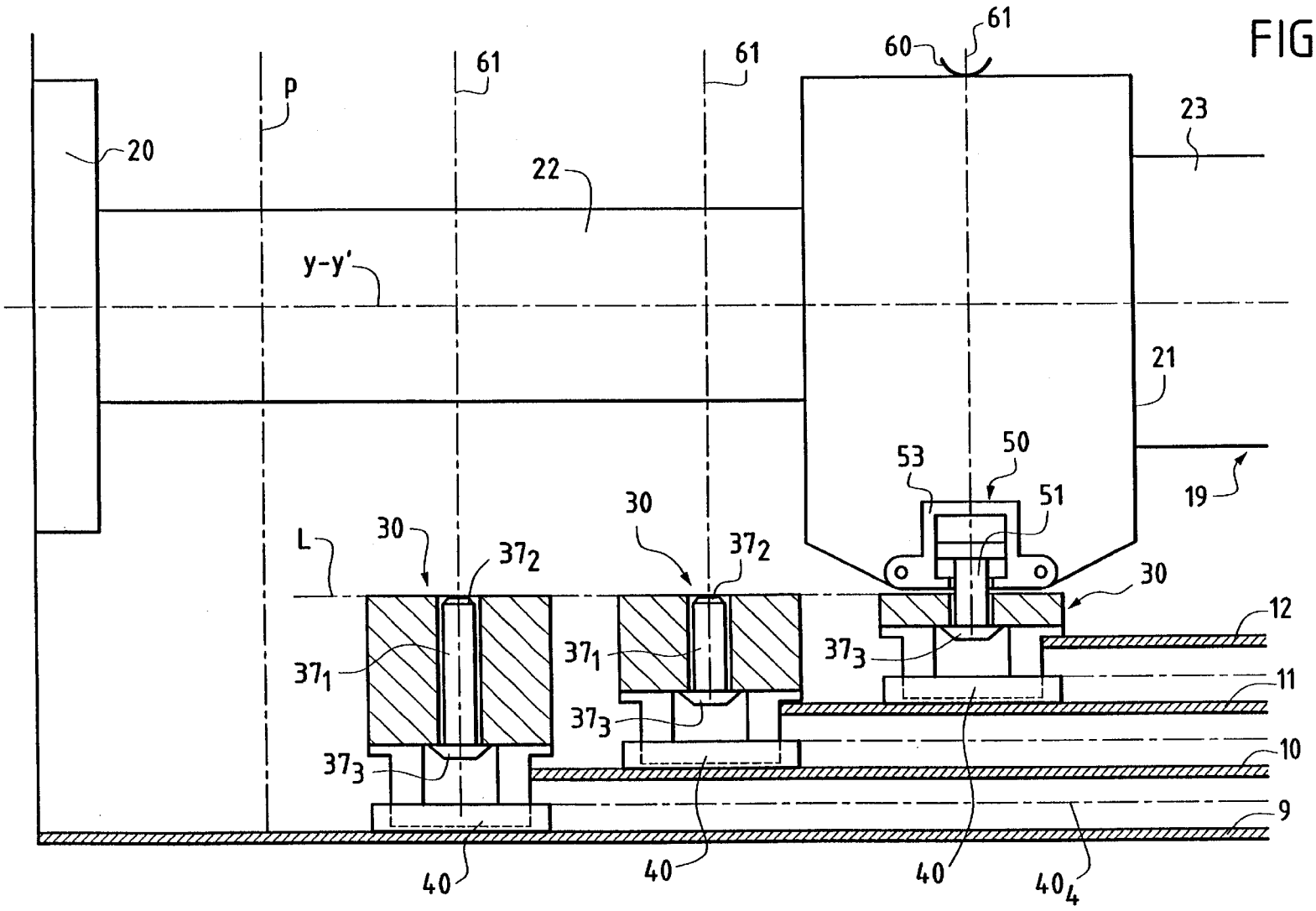
FIG. 8 is a fragmentary diagrammatic elevation view in section on a larger scale showing certain characteristic details.

In a structural detail, shown in FIG. 8, all of the above-described locking members 30 for the telescopic elements are organized in such a manner that the actuation faces $37_2$ of the plungers 37 are in alignment on a line or a plane such as L which is parallel to the axis y–y'.

For this purpose, and because of the offset that exists between the positions of the various locking blocks 30 due to the differences in section between the elements 10, 11, and 12 that carry them, the various plungers 37 are provided with respective shanks $37_1$ of different lengths such that the face 37 of each plunger lies in the plane or on the line L when the clamp 34 is in its clamping position, as described below.

Each locking member also comprises at least one immobilizing piece 40 of fixed position and belonging to the telescopic element immediately surrounding the telescopic element carrying the locking block 30 with which it is to co-operate.

Figure 7:
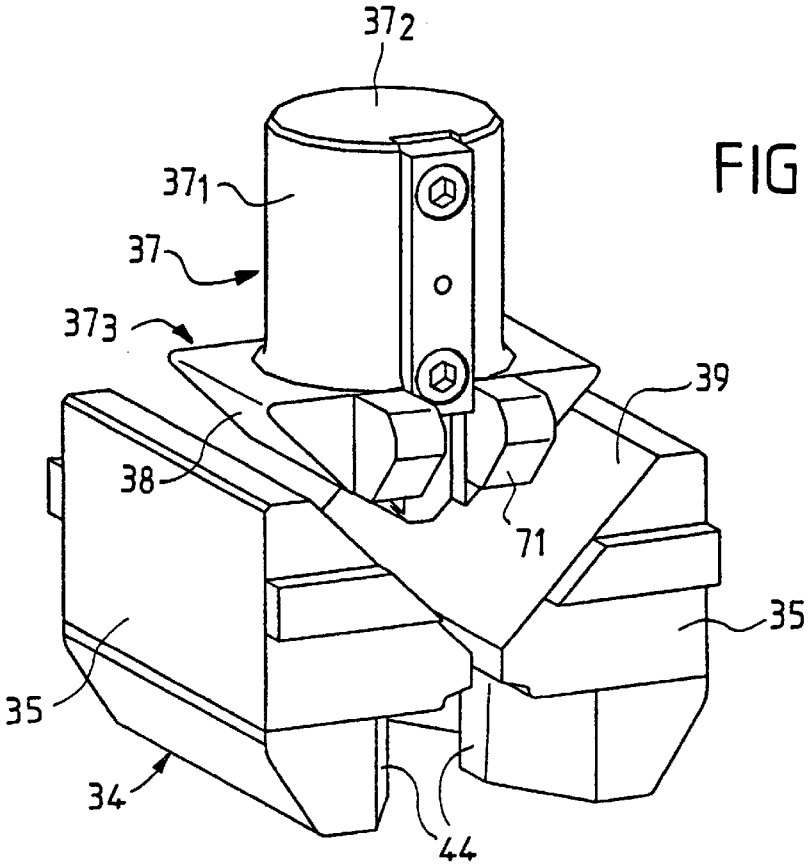
FIG. 7 is a fragmentary perspective view similar to FIG. 6 but with more parts omitted.
Figure 9:
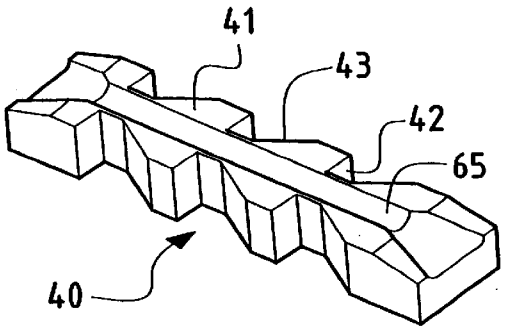
FIG. 9 is a perspective view at a different scale showing a structural detail.

This immobilization piece 40 is advantageously constituted by a segment of a bar designed to be held captive by and clamped between the facing faces of the jaws 35. To improve this function, the facing faces of the jaws 35 are advantageously shaped so as to be complementary to the flanks of the piece 40 against which the jaws 35 are urged by the springs 36. Advantageously, and as can be seen in FIG. 9, the piece 40 is constituted in the form of two racks having asymmetrical teeth 41 formed as opposing pairs along two longitudinal edges of the piece. Each asymmetrical tooth has a face 42 that is substantially orthogonal to the longitudinal axis of the piece 40 and a sloping face 43. The piece 40 is carried by the telescopic element in such a manner that the faces 42 look towards the head of the jib. Because of this double-rack shape, the facing faces of the jaws 35 are provided with shapes 44 that are complementary to the teeth 41 (FIG. 7). To allow the piece 40 to pass, each block 30 has a notch 45 in its bottom portion (FIG. 4).

Each piece 40 is fixed to the corresponding telescopic element so that when it co-operates with the block 30 corresponding to the telescopic element inside it they define a fixed position. Thus, as shown in FIG. 2, each element 9, 10, and 11 possesses on its inside two immobilization pieces 40 defining two co-operation positions for the locking block 30 corresponding to the immediately inner element, i.e. 10, 11, and 12, respectively. These two positions correspond respectively to the retracted position determined by the immobilization piece $40_1$ and to an extended position determined by the immobilization piece $40_2$.

In the meaning of the invention, it should be considered that each element 9, 10, or 11 can also have other immobilization pieces such as $40_3$ each serving to define a respective intermediate position.

In a variant embodiment, as represented in FIG. 8 by chain-dotted lines, the immobilization piece 40 can in fact be constituted by a continuous bar $40_4$ running along the entire working length of each element 9, 10, or 11, or along some of them, so as to make it possible to define not only extreme retracted and extended positions, but also n intermediate positions, as described below. Under such circumstances, the bar $40_4$ complies with the structural details described above for the piece 40.

The apparatus of the invention also comprises means carried by the actuator 19 for controlling the above-described members. Such means are given an overall reference 50 (FIGS. 2, 5, and 8) and they are said to be "moving"

since they are mounted on the telescoping head 21 carried by the actuator cylinder 23 in the example shown. In one embodiment, these means 50 comprise a member 51 suitable for occupying two relative positions under drive from a driver member 52. The first of these positions is a retracted position and the second is an engagement or coupling position where the member 51 is capable of co-operating with the locking block 30 of any one of the moving telescopic elements 10, 11, or 12.

In the invention, the member 51 is also designed to act on the clamping member 34 of each block 30 so that by taking positive action it neutralizes the clamping function of the member 34 and thus releases the locking block 30 from the immobilization piece 40 with which it co-operates. Thus, the member 51 is designed to perform two functions which take place as described below.

In an advantageous embodiment, the member 51 is constituted by a pin, e.g. formed by the piston rod of an actuator constituting the driver member 52. In such an embodiment, the driver member comprises an actuator cylinder 53 which is fixed to the telescoping head 21 in such a manner that the pin 51, when in its extended position, can be engaged in the well 31 of one of the locking blocks 30, thereby exerting thrust on the corresponding plunger 37.

The apparatus of the invention can also advantageously make use of a read cell (FIGS. 2 and 8) carried by the telescoping head 21 and suitable for assessing the presence of position markers 61 fitted to the inside walls of the elements 9, 10, and 11, as shown in FIG. 2.

The positions of the markers 61 are determined to correspond to the positions of the immobilization pieces $\mathbf{40}_1$ and also to a position p of maximum retraction in which the actuator 19 is out of operation. The cell 60 is also designed to detect the presence of position markers 62 which are provided to correspond to the immobilization pieces $\mathbf{40}_2$. Naturally, intermediate position markers could be provided in association with the pieces $\mathbf{40}_3$ or with some of the positions that can be defined by a piece $\mathbf{40}_4$.

The apparatus described above makes it possible to implement a telescoping method which, in accordance with the invention, takes place as follows.

Starting from a retracted telescoping position, the locking block 30 of each moving telescopic element, i.e. 10, 11, and 12, co-operates with the corresponding immobilization piece $\mathbf{40}_1$ carried by the immediately outer element, i.e. respectively 9 for the element 10, 10 for the element 11, and 11 for the element 12, in the relationship shown in FIG. 5. In this position, the springs 36 in each block 30 urge the jaws 35 against opposite sides of the corresponding immobilization piece 40 which is firmly held captive. As a result, each element is prevented from moving axially relative to the immediately outer element surrounding it and cannot be subject to any rearward sliding, even if the jib is tilted in elevation, given the shape of the teeth 41 of the double rack 40.

In this situation, all of the telescopic elements are immobilized relative to one another in a retracted position and they remain immobilized in a state of passive security, given that the clamping members 40 are of a type that is damped when in the rest position.

By way of example, the actuator 19 can occupy its out-of-service position shown in chain-dotted lines and corresponding to the position marker p, the actuator then being in its maximally retracted state.

When it is appropriate to proceed with extension telescoping, e.g. to extend the end element 12, the actuator 19 is controlled so as to move the telescoping head 21 until it comes up to the corresponding locking block 30, with this position being detected by the reader sensing the position marker 61 carried by the telescopic element 12.

When the telescoping head 21 places the pin 51 in register with the locking block 30, the driver 52 is powered so as to extend the pin 51 which is thus caused to penetrate into the well 31. The result of this action is to couple the head 21 in temporary manner with the block 30 and consequently to link the actuator 19 with the end telescopic element 12.

The driver 52 is powered so that the pin 51 extends to an extent such that it bears against the actuation face $\mathbf{37}_2$ of the plunger 37 which moves against the opposing action of the springs 36 to cause the jaws 35 to move apart, thereby releasing the immobilization piece 40.

Thus, initially, the pin 51 temporarily selects the actuator 19 and the moving element to be moved, and subsequently releases the moving element from the immediately outer element relative to which it was previously immobilized.

The actuator 19 is then caused to move e.g. in the direction of arrow $f_1$ (FIG. 2) depending on the sequence being implemented, so that its extension causes the moving element 12 to be moved in the same direction, thus being telescoped into its extended position. The actuator 19 operates until the cell 60 detects the position marker 62 carried by the element 11. Under such circumstances, the driver 52 is powered so as to retract the pin 51. In this respect, the driver 52 can be of the single-acting type as shown in the drawing or it can be of the double-acting type. Naturally, any other type of driver member can be implemented to perform the same function.

Figure 10:
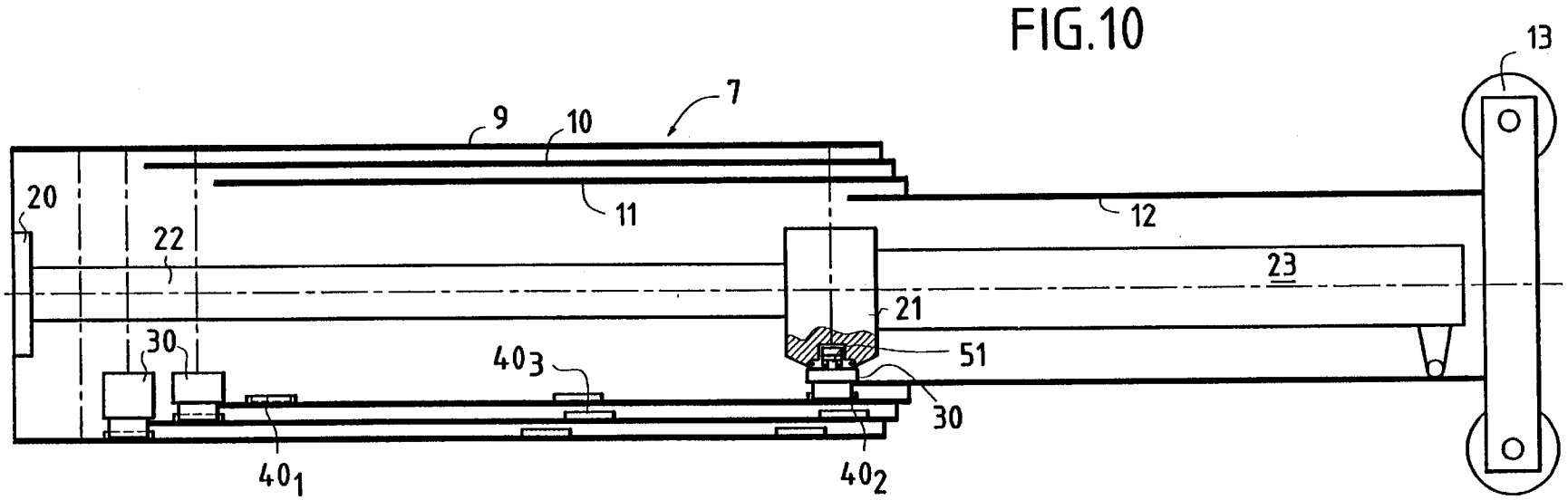
FIG. 10 is a diagrammatic elevation view on a smaller scale showing an operating position.

As the pin 51 is retracted, it begins by withdrawing sufficiently to release the force applied to the plunger 37 so that it can retract and allow the action of the springs 36 to become preponderant, thereby closing the jaws 35 and clamping them on the immobilization piece $\mathbf{40}_2$ presented by the element 11 to face them in the present circumstance (FIG. 10).

Continued retraction of the pin 51 then leads to it being extracted completely from the well thus decoupling it from the locking block 30, so that the temporary connection between the telescopic head 21 and said block is ended.

The extended telescoping element, in this case the element 12, is thus again immobilized relative to the element surrounding it, in this case the element 11, while the actuator 19 is decoupled therefrom and can be controlled to move in the opposite direction so as to return to the position p.

It should be observed that during this extension telescoping, guided relative movement between the actuator 19 and the element 12 is made possible because of the leg 24 and the wheels 25.

As can be seen from the above, a single engagement member carried by the actuator, and a single locking block carried by each element suffice for each stroke to be imparted to a moving element to enable said stroke (whether an extension stroke or a retraction stroke) to be performed: firstly by temporary coupling between the actuator and the element that is to be moved; secondly by releasing or unlocking the element to be moved relative to the element surrounding it; thirdly by moving said element to be moved; fourthly by immobilizing said moved element in the desired new position; and fifthly by decoupling said element and the actuator 19 which can then be returned to its original position, or to an active position in order to run the same sequence of events with another moving element such as 11, or 10.

The proposal of the invention serves clearly to simplify the locking, engaging, and actuation means by causing each of them to perform two functions, and in particular by causing the pin 51 to perform two functions, while nevertheless ensuring that all of the sequences can be performed with positive security that occurs automatically.

The two functions performed enable the size of the technical means implemented to be reduced and thus enable the mass thereof to be reduced. Other things remaining equal, such a saving can then be taken advantage of in order to reinforce the structure of the telescopic elements so as to increase their strength and thus improve the functional characteristics thereof under load.

Naturally, the method of the invention as described with reference to the extension stroke of element 12 can be performed in similar manner for the retraction stroke of that element, with the exception of the functional sequence specific to the direction in which the actuator 19 is moved.

Also naturally, similar sequences can be performed when it is desired to impart a retraction or an extension stroke to any of the other moving elements, and in this case specifically the intermediate elements 10 and 11.

In this respect, it should be observed that the sequence described above can be performed under exactly the same conditions for each of the elements, given that the plungers 37 are structurally organized so that they all lie in the same plane or on the same line L which corresponds to the trajectory that can be followed by the pin 51 and to its extension stroke for performing the two functions of coupling the telescoping head 21 with the block 30 and of neutralizing the clamping effect performed by the clamp 34.

In an advantageous disposition of the invention, the block 30 is mounted in floating manner in or on the telescopic element that carries it. As shown in FIGS. 3 and 5, such a floating mount can be established, for example, by providing the block with grooves 63 for co-operating with a housing 64 formed in the corresponding telescopic element so as to leave clearance J extending transversely to the longitudinal axis y–y'. Such a floating mount has the advantage of allowing co-operation between the members 30 and 40 and 30 and 50 to be accommodated in spite of any possible lateral movements of the telescopic elements. To this end, it is advantageous to provide for a frustoconical bearing surface 31*a* to constitute the entrance to the well 31.

Figure 11:
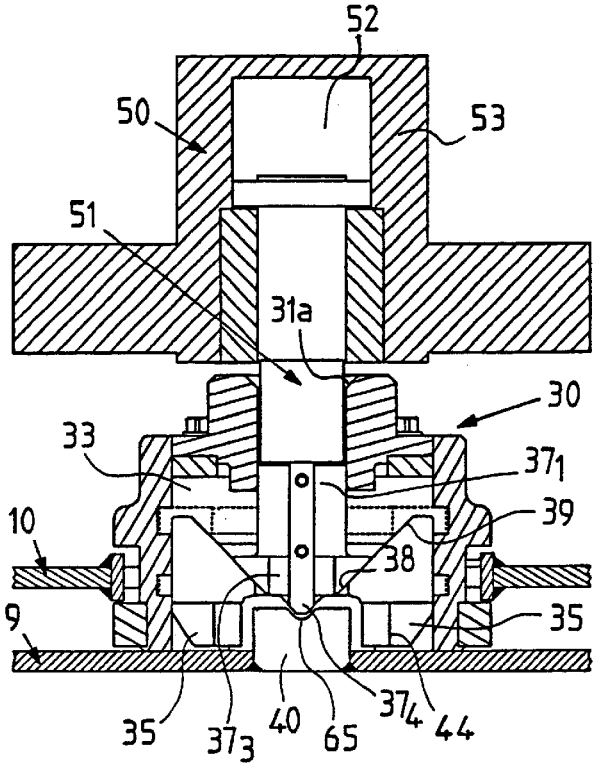
FIG. 11 is an elevation view in section corresponding to FIG. 5, but showing another characteristic position.
Figure 6:
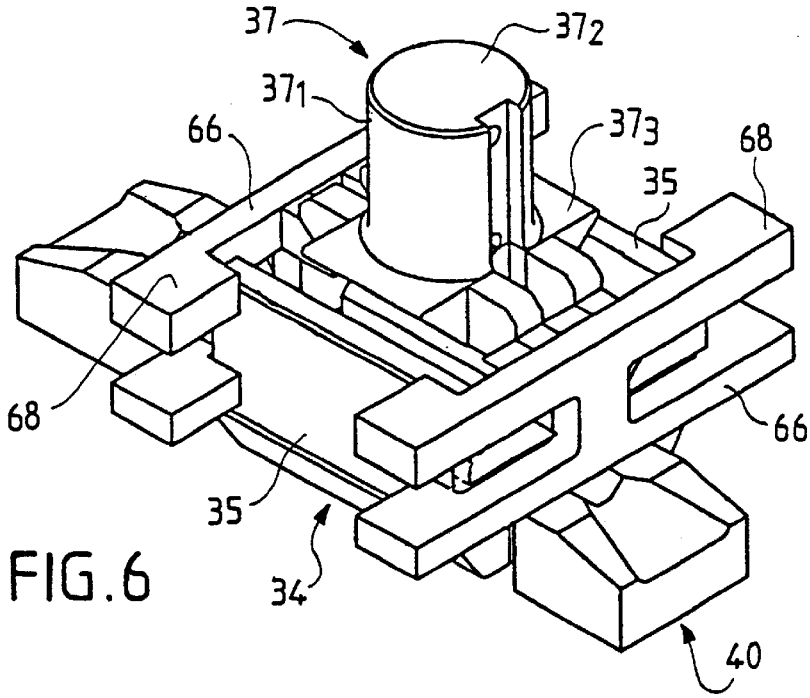
FIG. 6 is a fragmentary perspective view analogous to FIG. 4.

To ensure that the co-operation position is nevertheless indexed, the head $\mathbf{37}_3$ advantageously includes a finger $\mathbf{37}_4$ or the like for co-operating, in the unlocked position of the jaws 38, with a complementary slot 65 formed longitudinally in the top face of the piece 40 (FIG. 11).

FIGS. 4, 6, 7, 12, and 13 show that in another advantageous disposition, each block 30 can be provided with means that immobilize the jaws against any opening displacement other than that under the control of the plungers 37. To this end, the two jaws 35 are bracketed by two staples 66 disposed in the block 30 with springs 67 interposed to urge them to engage the jaws via their facing tines 68. Each staple has at least one spur 69 with a sloping ramp 70 placed to co-operate vertically with at least one complementary projection 71 presented by the head $\mathbf{37}_3$. Thus, when the head $\mathbf{37}_3$ is moved downwards by the member 50, the projection 71 acts on the ramp 70 which pushes back the staple so as to release the jaws 35 for subsequent opening displacement under drive from the head $\mathbf{37}_3$.

Figure 14:
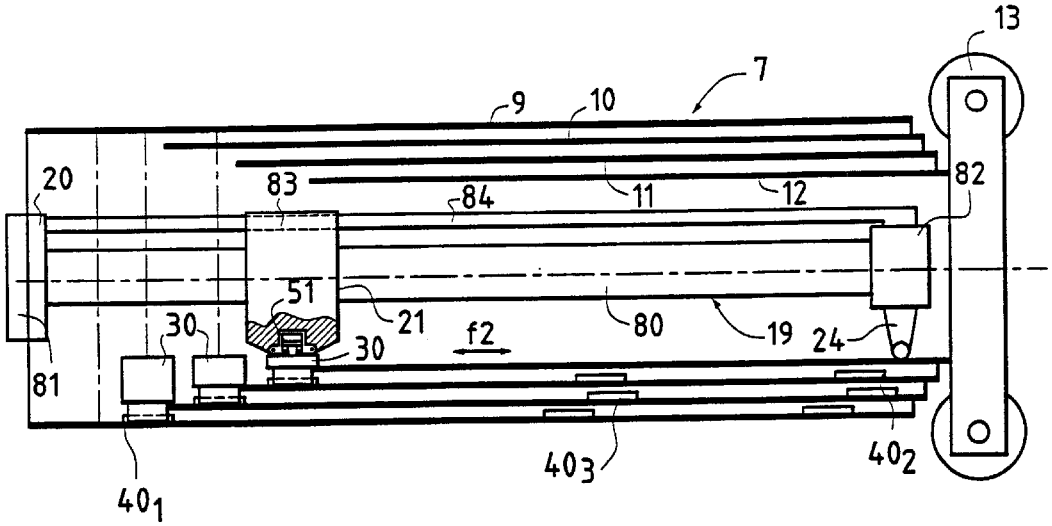
FIGS. 14 and 15 are diagrammatic elevation views in section analogous to FIG. 2, but showing two variant embodiments.

FIG. 14 shows a variant embodiment in which the actuator 19 is constituted by a wormscrew 80 which is connected to the fixed portion 20 via a motor and gearbox unit 81, which fixed portion 20 can advantageously constitute a bearing for one of the ends of the screw whose other end is mounted in a box 82 carried by the leg 24. The telescoping head 21 then constitutes a tapped body 83 co-operating with the wormscrew 80 and which is prevented from rotating, for example by guide rails 84 connecting the fixed bearing 20 to the box 82. In this manner, rotation of the screw 80 in one direction or the other enables the telescoping head 21 to be moved in one direction or the other as represented by arrow $f_2$ in the same manner as produced in the preceding embodiment by operating the actuator 22–23.

Figure 15:
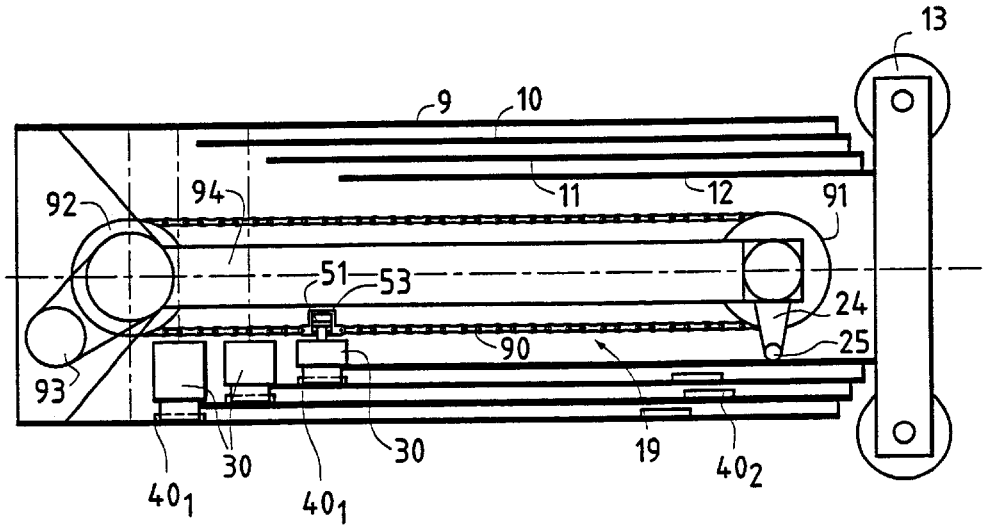

FIG. 15 shows another variant embodiment in which the actuator 19 is constituted by an endless chain 90 carried by sprocket wheels 91 and 92, one of which is a return wheel and the other is a drive wheel given that it is connected to a motor member 93 such as a hydraulic or an electrical motor associated with a gearbox.

The sprocket wheels 91 and 92 are preferably carried by a beam structure 94 performing the above requirements of being secured to the fixed point 20 and serving to guide displacement relative to the element 12 by means of a leg 24 and wheel(s) 25.

In another variant, the telescoping head 21 can advantageously be constituted merely by the body 53 of the motor that actuates the pin 51.

It should be considered that the pieces 40 and the block 30 and indeed the means 50 could be disposed in manners other than that shown, for example they could be placed on the top internal generator lines of the elements 9 to 11.

In the invention, provision can be made to constitute each driver 51 in the form of a telescopic actuator having two rods, one that performs the coupling function and the other that performs the function of controlling the plungers 37. An embodiment is shown in FIG. 16 where the body 53 defines a cylinder 95 containing a piston 96 extended by a rod 97 for penetrating in the well 31 so as to take on the function of coupling with the block 30. The rod 97 defines a cylinder 98 containing a secondary piston 99 which is extended by a rod 100 whose function is to act on the face $\mathbf{37}_2$ of the plunger 37. Thick dashed lines in FIG. 16 show that the cylinders 95 and 98 can constitute double-acting actuator cylinders. The invention is not limited to the embodiments described and shown since various modifications can be made thereto without going beyond the ambit of the invention.

What is claimed is:

1. A method of telescoping a crane jib comprising a base element, at least one intermediate element and an end element placed in mutual bearing relationship by centering spacers, the method comprising the steps of:

implementing an actuator for providing rectilinear displacement in opposite directions which is disposed inside the jib and which is connected to the base element of the jib;

implementing on each element other than the base element a locking block comprising a clamping member movable between a clamped rest position and an unclamped position;

causing the clamping member of each block to clamp at least one fixed-position immobilization piece belonging to the element disposed concentrically outside the element carrying the block;

implementing on the actuator a driver member moving an engagement member suitable for acting selectively on each of the locking blocks and movable between a retracted position and an extended position such as:

when moving from the retracted position to the extended position the engagement member firstly engages the locking block in order to connect the actuator to the block and secondly makes the clamping member moving from the clamped rest position to the unclamped position in order to unlock the locking block from the fixed-position immobilization piece;

and when moving from the extended position to the retracted position the engagement member firstly makes the clamping member moving from the unclamped position to the clamped rest position in order to lock the locking block on the fixed-position immobilization piece and secondly disengages the locking block in order to release the actuator from the locking block.

2. The method according to claim 1, comprising the additional steps of providing each element other than the end element with at least two immobilization pieces which are placed so as to define at least two reference positions for the element disposed concentrically inside the element carrying the immobilization pieces, i.e. the retracted position and an extended position of said element disposed concentrically inside the element carrying the immobilization pieces.

3. The method according to claim 1, comprising the additional steps of providing each element, other than the end element, with an immobilization piece extending along the entire working length of each element to define n intermediate positions for the element disposed concentrically inside the element carrying the immobilization piece between its retracted position and its extended position.

4. The method according to claim 1, wherein to telescope an element of the jib, the following steps are performed:

controlling the actuator to bring the engagement member into register with the locking block of said element;

immobilizing the actuator in the in-register position;

controlling the driver member to move the engagement member from the retracted position to the extended position such as the engagement member:

firstly engages the locking block in order to connect the actuator to the block;

and secondly makes the clamping member moving from the clamped rest position to the unclamped position in order to unlock the locking block from the fixed-position immobilization piece on which it was lock;

controlling the rectilinear actuator to drive the element for telescoping relative to the jib element surrounding it externally;

determining the new desired position;

stopping the actuator;

controlling the driver member to move the engagement member in opposite manner from the extended position to the retracted position such as the engagement member:

firstly makes the clamping member moving from the unclamped position to the clamped rest position in order to lock the locking block on the fixed-position immobilization piece;

and secondly disengages the locking block in order to release the actuator from the locking block;

controlling the actuator so that it returns to a fully retracted position.

5. An apparatus for telescoping a crane jib comprising a base element, at least one intermediate element and an end element, the apparatus comprising:

an actuator for rectilinear displacement in both directions to connected inside the jib to a base element thereof, the actuator having a telescoping head;

for each telescopic element other than the base element, a locking block comprising a clamping member movable between a clamped rest position and an unclamped position;

for each telescopic element other than the end element, at least one immobilization piece to be fixed on said telescopic element, the immobilization piece being designed to co-operate with the clamping member of the locking block;

driver means to be adapted on the telescoping head to displace an engagement member suitable for acting selectively on each of the locking blocks and movable between a retracted position and an extended position such as:

when moving from the retracted position to the extended position the engagement member firstly engages the locking block in order to connect the telescoping head to the block and secondly makes the clamping member moving from the clamped rest position to the unclamped position in order to unlock the locking block from the fixed-position immobilization piece;

and when moving from the extended position to the retracted position the engagement member firstly makes the clamping member moving from the unclamped position to the clamped rest position in order to lock the locking block on the fixed-position immobilization piece and secondly disengages the locking block in order to release the telescoping head from the locking block.

6. The apparatus according to claim 5, wherein:

the engagement member translates in a direction perpendicular to the travel direction of the actuator;

and the clamping member of each locking block translates in a direction perpendicular to the travel direction of the actuator and perpendicular to the direction of travel of the engagement member.

7. The apparatus according to claim 5, wherein the locking blocks and the immobilization pieces are fitted to the inner ends of the jib elements.

8. The apparatus according to claim 5, wherein each locking block possess drive means for the clamping member movable in a direction perpendicular to the travel direction of the actuator.

9. The apparatus according to claim 5, comprising for each telescopic element other than the end element at least two immobilization pieces in alignment parallel to the telescoping direction and defining for the element disposed concentrically inside the element carrying the immobilization pieces, two predetermined positions, namely a retracted position and an extended position.

10. The apparatus according to claim 5, comprising for each telescopic element other than the end element, an immobilization piece constituted by a rack running along the entire length of said element to define for the element disposed concentrically inside the element carrying the immobilization pieces in addition to a retracted position and an extended position, n intermediate immobilization positions.

11. The apparatus according to claim 5, wherein the immobilization piece is in the form of a double rack in which each tooth is defined by a face orthogonal to the longitudinal axis of the piece and facing towards the head of the jib, and also a sloping face.

12. The apparatus according to claim 5, wherein the telescoping actuator is constituted by a hydraulic actuator whose rod is secured to the base element and whose cylinder carries the telescoping head and is carried with the ability to move relative to the rod under guidance of the end element.

13. The apparatus according to claim 5, wherein the actuator is constituted by a wormscrew connected to a driver member fitted to the base element and carried by the end element with the ability to move relative thereto in guided manner, said screw co-operating with a tapped body that is prevented from rotating and that constitutes the telescoping head.

14. The apparatus according to claim 5, wherein the actuator is constituted by an endless chain carried by a return sprocket and by a drive sprocket themselves mounted on a beam structure to be connected to the base element and carried by the end element with the ability of moving in guided manner relative thereto, the endless chain carrying the telescoping head.

15. The apparatus according to claim 5, wherein each locking block comprises:

a well for engaging the engagement member;

a cage communicating with the well and containing the clamping member comprising two jaws movable between a close position corresponding to the clamped rest position and a remote position corresponding to the unclamped position, the jaws being permanently urged by resilient members into the close position;

a plunger being associated with the jaws, engaging the well and constituting means for driving said jaws simultaneously in the remote position.

16. The apparatus according to claim 15, wherein for each locking block:

the well has a axis perpendicular to the travel direction of the actuator;

the plunger translates in a direction perpendicular to the travel direction of the actuator;

and the clamping jaws translate in a direction perpendicular to the travel direction of the actuator and perpendicular to the direction of travel of the engagement member.

17. The apparatus according to claim 15, wherein the jaws have clamping faces shaped to co-operate with complementary flanks presented by each immobilization piece.

18. The apparatus according to claim 15, wherein the locking block includes, at its end opposite from the well, a notch through which the immobilization piece can pass.

19. The apparatus according to claim 15, wherein the plunger of the locking blocks have shanks whose drive faces are situated in a common plane L parallel to the longitudinal axis y–y'.

20. The apparatus according to claim 15, wherein the driver means comprise at least one pin forming the engagement member movable rectilinearly in both directions by a driver member in order to occupy a first position in which it is retracted relative to the locking block, and a second position in which, after being brought into coincidence with any one of the locking blocks, it projects so as to be engaged in the well thereof in order to couple the actuator temporarily to the element and in order to act on the plunger to cause the clamping jaws of said block to move in the remote or unclamped position.

21. The apparatus according to claim 20, wherein the pin is constituted by the piston rod of an actuator constituting the driver member.

22. The apparatus according to claim 15, wherein:

the locking block is to be mounted to float transversely;

and the plunger possesses a head that is extended by an indexing finger suitable for co-operating with a slot presented in the immobilization pieces.

23. The apparatus according to claim 15, wherein the locking block includes internally two staples urged by springs to engage around the clamping jaws and each carrying at least one separator ramp that co-operates with a projection of the plunger head.

24. A crane jib comprising:

a base element, at least one intermediate element and an end element placed in mutual bearing relationship by centering spacers;

an actuator for rectilinear displacement in both directions, the actuator being inside the jib and connected to the base element and having a telescoping head;

a locking block carried by each element other than the base element, the locking block comprising a clamping member movable between a clamped rest position and an unclamped position;

at least one immobilization piece of fixed position on each telescopic element other than the end element and designed to co-operate with the clamping member of the locking block;

driver means adapted on the telescoping head to displace an engagement member suitable for acting selectively on each of the locking blocks and movable between a retracted position and an extended position such as:

when moving from the retracted position to the extended position the engagement member firstly engages the locking block in order to connect the telescoping head to the block and secondly makes the clamping member moving from the clamped rest position to the unclamped position in order to unlock the locking block from the fixed-position immobilization piece;

and when moving from the extended position to the retracted position the engagement member firstly makes the clamping member moving from the unclamped position to the clamped rest position in order to lock the locking block on the fixed-position immobilization piece and secondly disengages the locking block in order to release the telescoping head from the locking block.

25. The crane jib according to claim 24, wherein:

the engagement member translates in a direction perpendicular to the travel direction of the actuator;

and the clamping member of each locking block translates in a direction perpendicular to the travel direction of the actuator and perpendicular to the direction of travel of the engagement member.

26. The crane jib according to claim 24, wherein the locking blocks and the immobilization pieces are fitted to the inner ends of the jib elements.

27. The crane jib according to claim 24, wherein each locking block possess drive means for the clamping member movable in a direction perpendicular to the travel direction of the actuator.

28. The crane jib according to claim 24, comprising on each telescopic element other than the end element at least two immobilization pieces in alignment parallel to the telescoping direction and defining for the element disposed concentrically inside the element carrying the immobilization pieces, two predetermined positions, namely a retracted position and an extended position.

29. The crane jib according to claim 24, comprising on each telescopic element other than the end element, an immobilization piece constituted by a rack running along the entire length of said element to define for the element disposed concentrically inside the element carrying the immobilization pieces in addition to a retracted position and an extended position, n intermediate immobilization positions.

30. The crane jib according to claim 24, wherein the immobilization piece is in the form of a double rack in which each tooth is defined by a face orthogonal to the longitudinal axis of the piece and facing towards the head of the jib, and also a sloping face.

31. The crane jib according to claim 24, wherein the telescoping actuator is constituted by a hydraulic actuator whose rod is secured to the base element and whose cylinder carries the telescoping head and is carried with the ability to move relative to the rod under guidance of the end element.

32. The crane jib according to claim 24, wherein the actuator is constituted by a wormscrew connected to a driver member fitted to the base element and carried by the end element with the ability to move relative thereto in guided manner, said screw co-operating with a tapped body that is prevented from rotating and that constitutes the telescoping head.

33. The crane jib according to claim 24, wherein the actuator is constituted by an endless chain carried by a return sprocket and by a drive sprocket themselves mounted on a beam structure to be connected to the base element and carried by the end element with the ability of moving in guided manner relative thereto, the endless chain carrying the telescoping head.

34. The crane jib according to claim 24, wherein each locking block comprises:

a well for engaging the engagement member;

a cage communicating with the well and containing the clamping member comprising two jaws movable between a close position corresponding to the clamped rest position and a remote position corresponding to the unclamped position, the jaws being permanently urged by resilient members into the close position;

a plunger being associated with the jaws, engaging the well and constituting means for driving said jaws simultaneously in the remote position.

35. The crane jib according to claim 34, wherein for each locking block:

the well has a axis perpendicular to the travel direction of the actuator the plunger translates in a direction perpendicular to the travel direction of the actuator;

and the clamping jaws translate in a direction perpendicular to the travel direction of the actuator and perpendicular to the direction of travel of the engagement member.

36. The crane jib according to claim 34, wherein the jaws have clamping faces shaped to co-operate with complementary flanks presented by each immobilization piece.

37. The crane jib according to claim 34, wherein the locking block includes, at its end opposite from the well, a notch through which the immobilization piece can pass.

38. The crane jib according to claim 34, wherein the plunger of the locking blocks have shanks whose drive faces are situated in a common plane L parallel to the longitudinal axis y–y'.

39. The crane jib according to claim 34, wherein the driver means comprise at least one pin forming the engagement member movable rectilinearly in both directions by a driver member in order to occupy a first position in which it is retracted relative to the locking block, and a second position in which, after being brought into coincidence with any one of the locking blocks, it projects so as to be engaged in the well thereof in order to couple the actuator temporarily to the element and in order to act on the plunger to cause the clamping jaws of said block to move in the remote or unclamped position.

40. The crane jib according to claim 39, wherein the pin is constituted by the piston rod of an actuator constituting the driver member.

41. The crane jib according to claim 34, wherein:

a the locking block is to be mounted to float transversely;

and the plunger possesses a head that is extended by an indexing finger suitable for co-operating with a slot presented in the immobilization pieces.

42. The crane jib according to claim 34, wherein the locking block includes internally two staples urged by springs to engage around the clamping jaws and each carrying at least one separator ramp that co-operates with a projection of the plunger head.

* * * * *